US008405567B2

(12) United States Patent
Park et al.

(10) Patent No.: US 8,405,567 B2
(45) Date of Patent: Mar. 26, 2013

(54) METHOD AND APPARATUS FOR CONTROLLING RADIATION DIRECTION OF SMALL SECTOR ANTENNA

(75) Inventors: Ju Derk Park, Daejeon (KR); Kang Woo Lee, Daejeon (KR); Sang Joon Park, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 586 days.

(21) Appl. No.: 12/640,775

(22) Filed: Dec. 17, 2009

(65) Prior Publication Data

US 2010/0156722 A1 Jun. 24, 2010

(30) Foreign Application Priority Data

Dec. 18, 2008 (KR) ..... 10-2008-0129162

(51) Int. Cl.
*H01Q 19/00* (2006.01)

(52) U.S. Cl. ..... 343/833; 343/817; 343/893

(58) Field of Classification Search ..... 343/893, 343/817, 833; 342/374
See application file for complete search history.

(56) References Cited

U.S. PATENT DOCUMENTS

| | | | | |
|---|---|---|---|---|
| 5,767,807 | A | 6/1998 | Pritchett | |
| 6,407,719 | B1 | 6/2002 | Ohira et al. | |
| 6,677,898 | B2 | 1/2004 | Cheng et al. | |
| 2002/0105471 | A1 | 8/2002 | Kojima et al. | |
| 2003/0193446 | A1 | 10/2003 | Chen | |
| 2005/0206573 | A1 | 9/2005 | Iiagusa et al. | |
| 2006/0232492 | A1 | 10/2006 | Sawatani | |
| 2009/0039884 | A1* | 2/2009 | Schiano | 324/307 |
| 2009/0325521 | A1* | 12/2009 | Dubash et al. | 455/150.1 |
| 2010/0149052 | A1* | 6/2010 | Nishio et al. | 343/745 |

FOREIGN PATENT DOCUMENTS

| | | | |
|---|---|---|---|
| JP | 2001-24431 | A | 1/2001 |
| JP | 2004-120699 | A | 4/2004 |
| KR | 1998-0006617 | A | 3/1998 |
| KR | 1020020013975 | A | 2/2002 |

* cited by examiner

*Primary Examiner* — Jack W Keith
*Assistant Examiner* — Fred H Mull
(74) *Attorney, Agent, or Firm* — Ladas & Parry LLP

(57) ABSTRACT

Disclosed are an apparatus and method for controlling a radiation direction of a small sector antenna, used for a small wireless transmission device having limited power and calculation capabilities, capable of operating at a low power consumption with the necessity of simple calculation capabilities or without the necessity of even a few calculation capabilities. The apparatus for controlling a radiation direction of a small sector antenna includes a plurality of capacitance blocks including a plurality of capacitors each having one end commonly connected to corresponding parasitic elements and having a different capacitance. Capacitors having a capacitance corresponding to a radiation direction are selectively connected to corresponding parasitic elements through a plurality of switching units and a controller, thereby simplifying controlling and reducing power consumption for controlling the radiation direction.

6 Claims, 5 Drawing Sheets

METHOD AND APPARATUS FOR CONTROLLING RADIATION DIRECTION OF SMALL SECTOR ANTENNA

CROSS-REFERENCE TO RELATED APPLICATIONS

This application claims the priority of Korean Patent Application No. 10-2008-0129162 filed on Dec. 18, 2008, in the Korean Intellectual Property Office, the disclosure of which is incorporated herein by reference.

BACKGROUND OF THE INVENTION

1. Field of the Invention

The present invention relates to an apparatus and method for controlling a propagation direction of a small sector antenna used for a small wireless system having limited power and calculation capacity such as a mobile communications terminal or a sensor node of a sensor network.

2. Description of the Related Art

Unlike an existing network, a wireless sensor network is basically configured to aim at the automatic and remote collection of information, rather than being a means of communication, a configuration which is extensively utilized in various fields of application such as for scientific, medical, military, commercial purposes. The sensor network includes a plurality of sensor nodes that detect information through a sensor and transmit the same, and a sink node that transmits the information which has been collected through the plurality of sensor nodes to the exterior.

Each sensor node has a simple structure including a sensor detecting information, a processor processing the detected information, and a wireless transmission/reception unit transmitting the processed information. For the convenience of installation and use, each sensor is required to be designed to consume little power and be compact so as to operate for a long time with limited battery power. In order to satisfy the demand for low power consumption and compactness, each sensor node generally has a simplified function and structure, having limited calculation capabilities.

Meanwhile, in order to configure an antenna detecting a propagation direction or indicating a directional radiation direction, a phased array antenna or a wireless communication system supporting multiple ports has generally been employed. However, the phased array antenna and the wireless communication system consume much power, need to have a high calculation capability, and need to include a plurality of RF ports.

In comparison, the small wireless device having a low-power consumption and limited calculation capabilities like the sensor node mostly supports an RF output of a single port and needs to control only the direction of a limited number of sectors.

Thus, in the case of the small wireless device such as the sensor node, it does not use a plurality of radiators like the phased array antenna to control the propagation direction but to configure an antenna with a single radiator and a plurality of parasitic elements to adjust an electrical length of a parasitic element and uses the interference between elements.

FIG. 1 illustrates a small sector antenna generally used in a small wireless device.

With reference to FIG. 1, the small sector antenna 10 includes a single monopole antenna 11 and a plurality of parasitic elements 12 installed at regular intervals in a circular form around the monopole antenna 11. A reference numeral 13 in FIG. 1 denotes a disk-type metal ground on which the monopole antenna 11 and the plurality of parasitic elements 12 are fixed. In this case, the length of the monopole antenna 11, the length of the parasitic elements 12, the distance between the monopole antenna 11 and the parasitic element 12, and the thickness of the disk-type metal ground are designed to be $\lambda/4$ ($\lambda$: radio signal wavelength).

The radiation direction of the small sector antenna is controlled by changing an electrical equivalent length according to a change in capacitance of the plurality of parasitic elements 12.

In the related art, a varactor diode is commonly used as a means of controlling the capacitance of the plurality of parasitic elements 12, which, however, disadvantageously accompanies a complicated calculation to appropriately adjust a nonlinear corresponding relationship between a bias voltage and the radiation direction.

In addition, in order to convert a digital bit stream generated according to the complicated calculation into a bias voltage of the varactor diode, a digital-to-analog converter (DAC) must be provided to increase the power consumption.

SUMMARY OF THE INVENTION

An aspect of the present invention provides an apparatus and method for controlling a radiation direction of a small sector antenna, used for a small wireless transmission device having limited power and calculation capabilities, capable of operating with low power consumption and either with or without the necessity of simple calculation capabilities.

According to an aspect of the present invention, there is provided an apparatus for controlling a radiation direction of a small sector antenna including a single radio frequency (RF) port and an array of a plurality of parasitic elements, including: a plurality of capacitance blocks matched to the plurality of parasitic elements in a one-to-one manner and including a plurality of capacitors commonly connected to corresponding parasitic elements and each having a different capacitance; a plurality of switching units matched to the plurality of capacitance blocks in a one-to-one manner and including a plurality of selective contact points connected to the other ends of the plurality of capacitors of the corresponding capacitance blocks and a fixed contact point connected to a ground, and performing a switching operation such that the fixed contact point is connected to one of the plurality of selective contact points; and a controller controlling the plurality of switching units such that set capacitors are connected to the plurality of parasitic elements according to a selected radiation direction.

The plurality of capacitance blocks may include n ($N_s/2+1$) number of capacitors (where $N_s$ is the number of sectors obtained by dividing the radiation direction of the small sector antenna into certain areas and n is the number of capacitors).

The controller may control the switching units such that parasitic elements located at symmetrical sectors, based on the radiation direction, have the same capacitance and parasitic elements located at sectors in the radiation direction have different capacitances.

The plurality of switching units may be directly connected to parasitic elements to which corresponding capacitance blocks are connected, and further include two selective contact points set for a short mode and an open mode.

The plurality of switching units may be implemented as digital switches connecting a single selective contact point to the fixed contact point according to a control signal from the controller and maintaining the connected state until a next control signal is applied.

According to another aspect of the present invention, there is provided a method for controlling a radiation direction of a small sector antenna including a single RF port and an array of a plurality of parasitic elements, including: dividing a radiation direction of the small sector antenna into a plurality of sectors and setting the same; disposing a plurality of capacitors between the plurality of parasitic elements and grounds; and selectively connecting the capacitors between the respective parasitic elements and the grounds such that parasitic elements located at symmetrical sectors, based on a selected radiation direction, have the same capacitance and parasitic elements located at sectors in a radiation direction have mutually different capacitances.

The plurality of capacitors may include n ($N_s/2+1$) number of capacitors (where $N_s$ is the number of sectors obtained by dividing the radiation direction of the small sector antenna into certain areas and n is the number of capacitors).

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
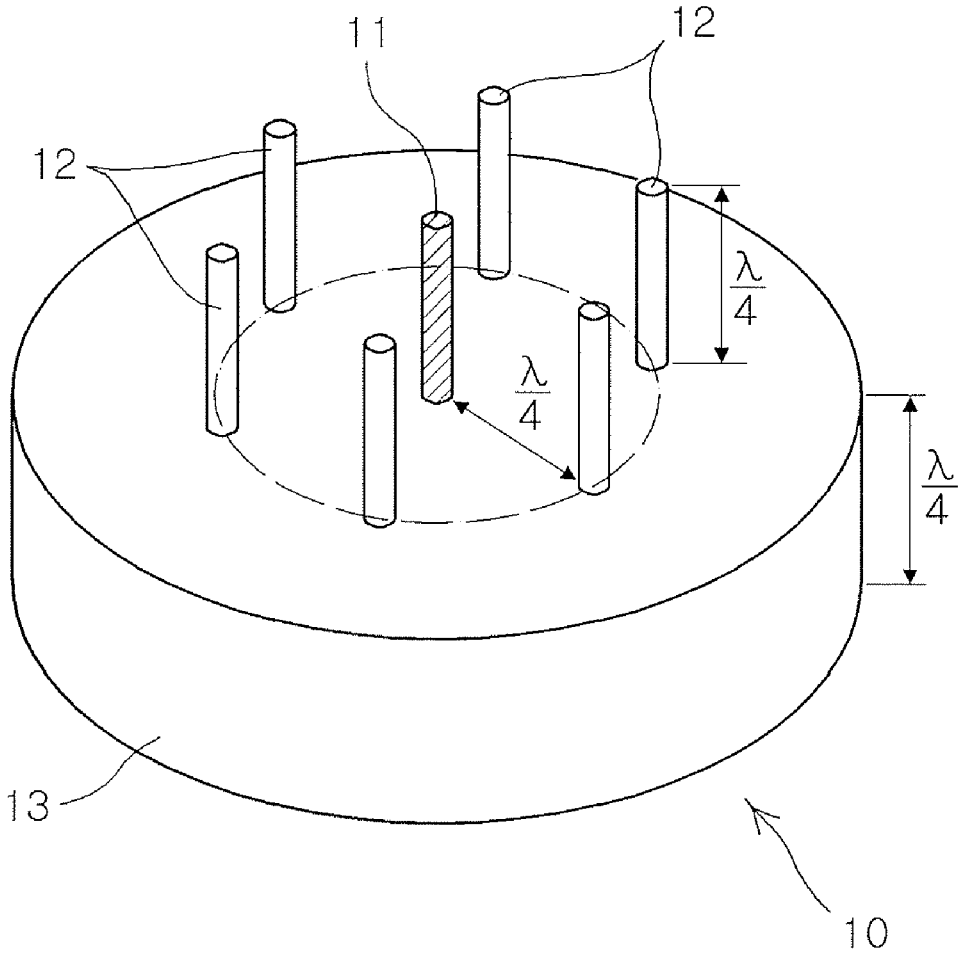
FIG. 1 illustrates a small sector antenna generally used for a small wireless device.

Exemplary embodiments of the present invention will now be described in detail with reference to the accompanying drawings. The invention may however be embodied in many different forms and should not be construed as limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

It will be understood that when an element is referred to as being "connected with" another element, it can be directly connected with the other element or intervening elements may also be present. In contrast, when an element is referred to as being "directly connected with" another element, there are no intervening elements present. In addition, unless explicitly described to the contrary, the word "comprise" and variations such as "comprises" or "comprising," will be understood to imply the inclusion of stated elements but not the exclusion of any other elements.

Figure 2:
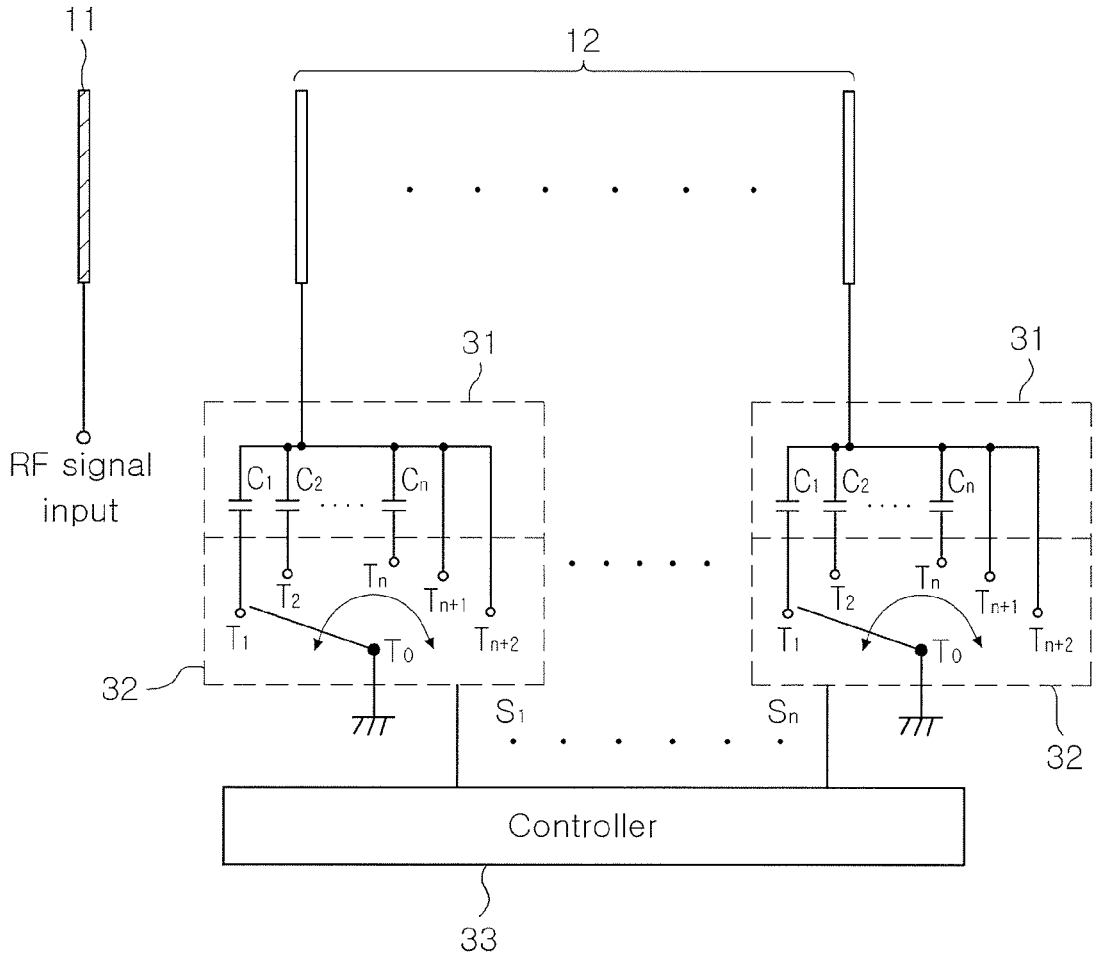
FIG. 2 is a schematic block diagram showing an apparatus for controlling a radiation direction of a small sector antenna according to an exemplary embodiment of the present invention.

FIG. 2 is a schematic block diagram showing an apparatus for controlling a radiation direction of a small sector antenna according to an exemplary embodiment of the present invention.

With reference to FIG. 2, the apparatus for controlling a radiation direction of a small sector antenna according to an exemplary embodiment of the present invention includes a plurality of capacitance blocks 31, a plurality of switching units 32, and a controller 33. The plurality of capacitance blocks 31 and the plurality of switching units 32 are matched to a plurality of parasitic elements 12 in a one-to-one manner, and connected in series between the parasitic elements 12 and grounds. The controller 33 controls the switching operations of the plurality of switching units 32.

Each of the switching units 32 includes a selective (n+2) number of selective contact points ($T_1$~$T_{n+2}$), two more than the number (n) of the capacitors of each of the capacitance blocks 31. The n number of contact points $T_1$~$T_n$ are connected to the capacitors of each capacitance block 31, and the two remaining contact points ($T_{n+1}$, $T_{n+2}$) are directly connected with the corresponding parasitic elements 12 and set for a short mode and an open mode. A fixed contact point ($T_0$) of each of the switching unit 32 is connected to a ground. Each switching unit 32 connects one of the plurality of capacitors to the corresponding parasitic element 12 by selectively connecting one of the plurality of selective contact points ($T_1$~$T_{n+2}$) to the fixed contact point $T_0$, or short-circuits or opens the parasitic element 12, under the control of the controller 33.

After selecting one of the selective contact points ($T_1$~$T_{n+2}$) according to a controls signal from the controller 33, the switching unit 32 preferably maintains the selected state until when a next control signal is applied, for which the switching unit 32 may be implemented as a digital switch.

Each of the plurality of capacitance blocks 31 includes a plurality of capacitors $C_1$~$C_n$, each having a different capacitance value, connected in parallel. The one ends of the plurality of capacitors $C_1$~$C_n$ are commonly connected to the parasitic element 12 and the other ends of the plurality of capacitors $C_1$~$C_n$ are connected with the plurality of selective contact points T1~$T_n$ provided in the switching unit 32.

The number (n) of capacitors provided in the capacitance block 31 varies depending on the number of sectors, namely, the number (Ns) of parasitic monopole antennas, which may be defined by Equation 1 shown below:

$$n=N_s/2+1$$

Figure 3:
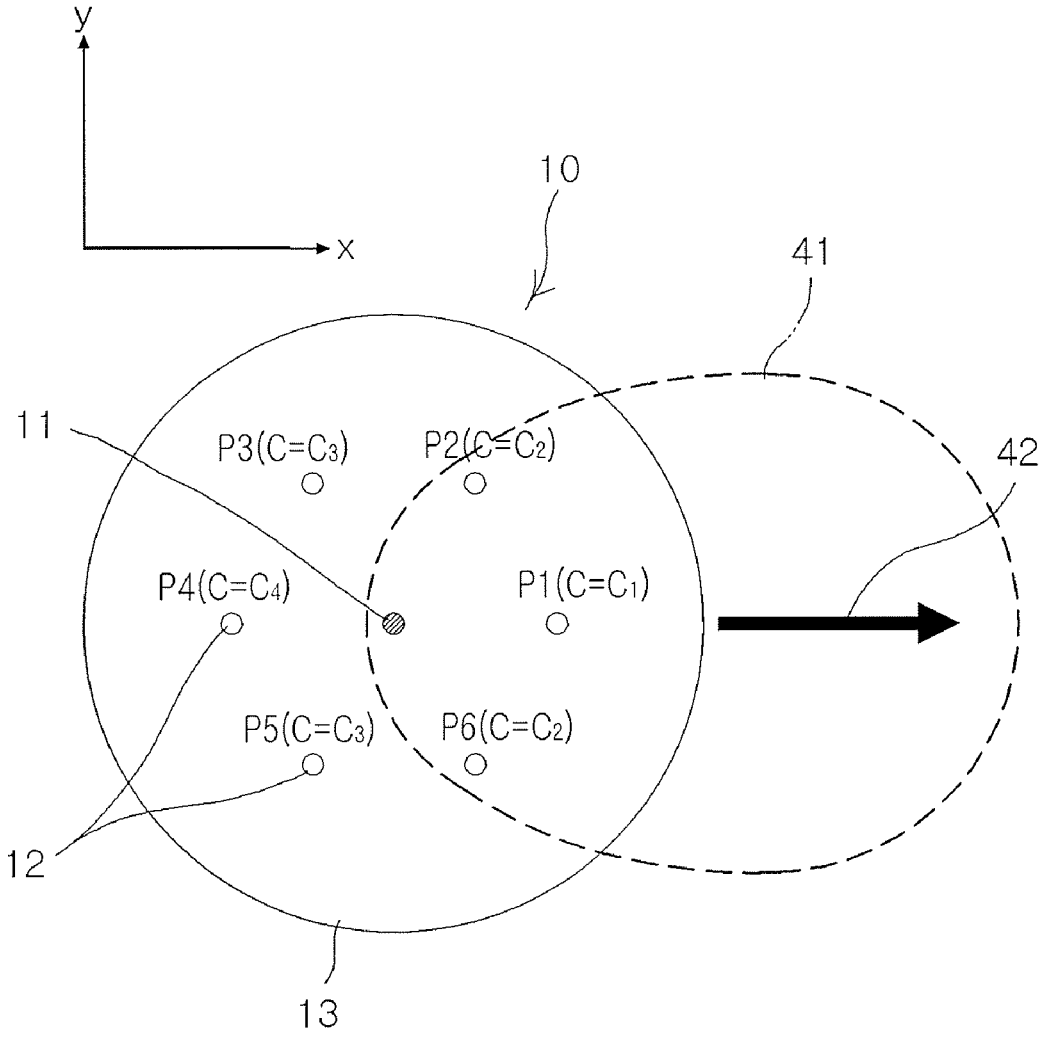
FIGS. 3 and 4 illustrate radio wave radiation directions in each capacitance distribution in controlling a radiation direction according to an exemplary embodiment of the present invention.
Figure 4:
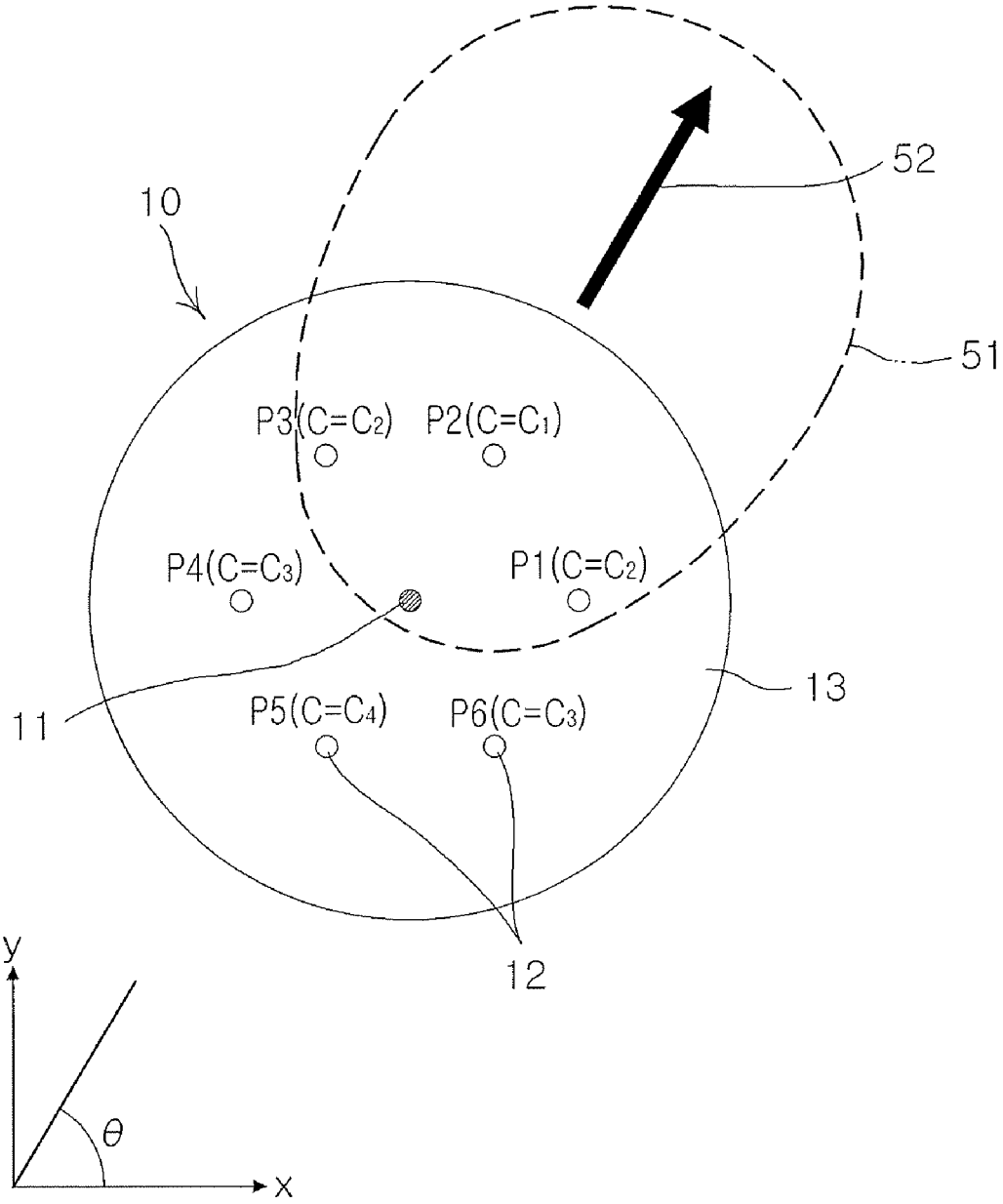

The reason why the number (n) of the capacitors is defined in this way is because, for controlling a radiation direction of a small sector antenna, the parasitic elements 12 located at symmetrical sectors, based on the radiation directions as shown in FIGS. 3 and 4, must have the same capacitance and parasitic elements 12 located in the radiation direction must have different capacitances.

For example, as shown in FIG. 1, it is assumed that six parasitic elements 12 are provided and the radiation direction of the small sector antenna operating with six sectors is controlled, capacitance values connected to the respective parasitic elements 12 according to radio wave radiation directions may be represented by Table 1 shown below:

TABLE 1

| | P1 | P2 | P3 | P4 | P5 | P6 |
|---|---|---|---|---|---|---|
| Φ = 0 W | $C_1$ | $C_2$ | $C_3$ | $C_4$ | $C_3$ | $C_2$ |
| Φ = 60 W | $C_2$ | $C_1$ | $C_2$ | $C_3$ | $C_4$ | $C_3$ |
| Φ = 120 W | $C_3$ | $C_2$ | $C_1$ | $C_2$ | $C_3$ | $C_4$ |
| Φ = 180 W | $C_4$ | $C_3$ | $C_2$ | $C_1$ | $C_2$ | $C_3$ |
| Φ = 240 W | $C_3$ | $C_4$ | $C_3$ | $C_2$ | $C_1$ | $C_2$ |
| Φ = 300 W | $C_2$ | $C_3$ | $C_4$ | $C_3$ | $C_2$ | $C_1$ |

Here, P1~P6 represent the six parasitic elements 12, and $C_1$~$C_4$ are capacitors each having a different capacitance. The capacitance values of $C_1$~$C_4$ are determined according to the distribution of an electrical equivalent length required for each parasitic element according to the radiation direction.

Thus, in the apparatus for controlling a radiation direction according to an exemplary embodiment of the present invention, the number (n) of the capacitors arranged in the capacitance block 31 is one more than the number (Ns/2) of the sectors of the small sector antenna.

The controller 33 controls the switching operations of the plurality of switching units 32 such that the capacitors are connected to the respective parasitic elements 12 with such a distribution as shown in the Table 1 according to a selected radiation direction. In the present exemplary embodiment, as mentioned above, the capacitors connected to the respective parasitic elements 12 can be previously determined. Thus, the controller 31 can control the radiation direction without limited calculation capabilities or without calculation capabilities by previously setting control signals (a digital bit stream) for controlling the radiation direction such that they are matched to a radiation direction of each sector in a one-to-one manner within the controller 31.

The operation of the apparatus for controlling a radiation direction of the small sector antenna according to an exemplary embodiment of the present invention will now be described.

In the controller 33 of the apparatus for controlling a radiation direction according to an exemplary embodiment of the present invention, there are set the capacitors connected to the plurality of parasitic elements 12 according to radio wave radiation direction divided into $N_s$ number of sectors as shown in Table 1 and the control signals (a digital bit stream) S1~Sn of the plurality of switching units 32 for connecting the capacitors.

Accordingly, when a radiation direction is selected, the controller 33 applies the control signals S1~Sn corresponding to the selected radiation direction, to the plurality of switching units 32.

Then, each switching unit 32 selects one of the selective contact points ($T_1$~$T_{n+2}$) according to the input control signals S1~Sn, and connects the same to the fixed contact point.

As a result, a required capacitor is connected to provide the selected radiation direction to each of the plurality of parasitic elements 12.

Figure 5:
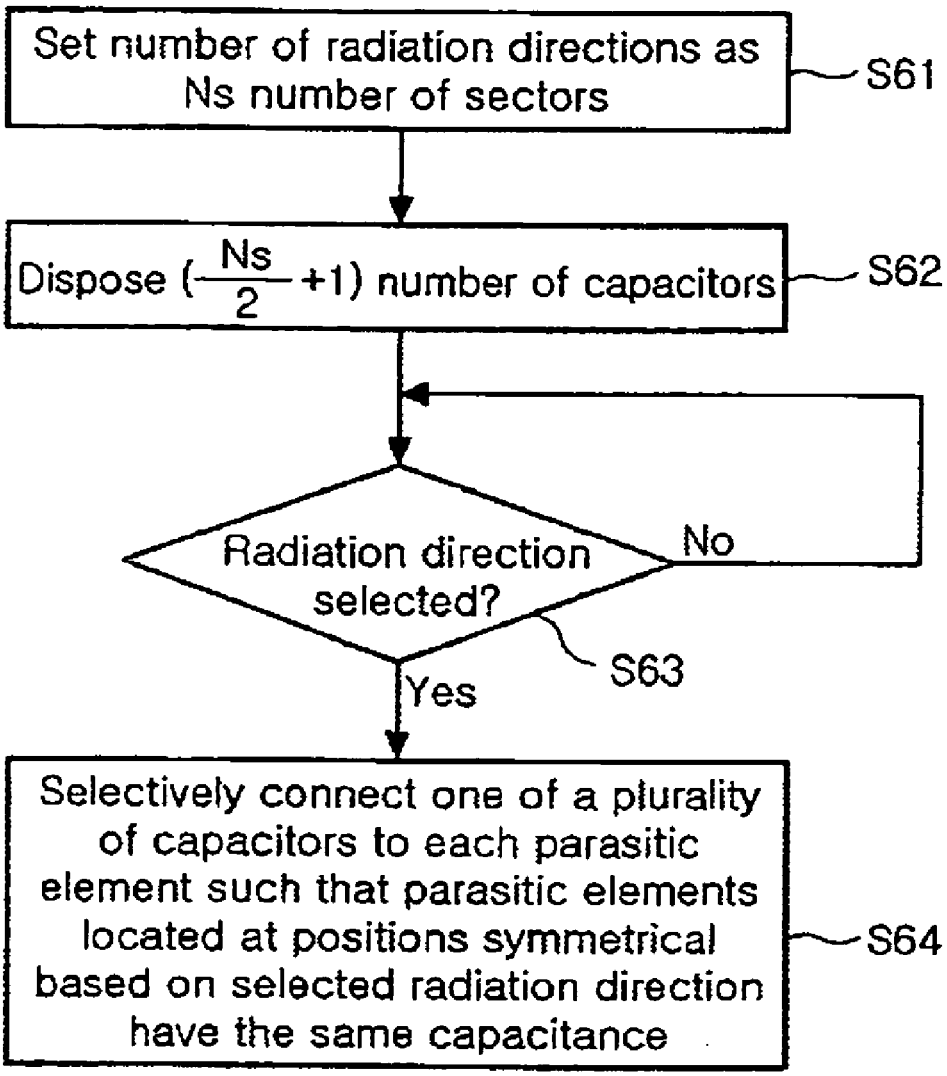
FIG. 5 is a flow chart illustrating the process of a method for controlling a radiation direction of a small sector antenna according to an exemplary embodiment of the present invention.

FIGS. 3 and 4 illustrate radio wave radiation directions in each capacitance distribution in controlling a radiation direction according to an exemplary embodiment of the present invention. With respect to the six parasitic elements 12 disposed in a circular form around the monopole antenna 11, when a parasitic element located in an x-axis direction is P1 and the parasitic elements sequentially disposed counterclockwise starting from P1 are P2 to P6, if a capacitance value connected with P1 is $C_1$, a capacitance value connected with P2 and P6 is $C_2$, a capacitance value connected with P3 and P5 is $C_3$, and a capacitance value connected with P4 symmetrical to P1 is $C_4$ as shown in FIG. 4, a radiation direction 42 of the monopole antenna 11 is controlled in the x-axis direction. As shown in FIG. 5, when the radiation direction 52 is shifted by 60 degrees counterclockwise, the capacitance values connected with P1 to P6 have a form which has been shifted by 60 degrees from the disposition of FIG. 3, respectively.

With reference to FIGS. 3 and 4, reference numerals and 51 denote a radiation shape appearing as the capacitances are connected. The capacitance is highest in the parasitic element direction where the capacitance value is $C_1$, and it becomes smaller as it goes to the peripheral areas, forming an oval shape.

FIG. 5 is a flow chart illustrating the process of a method for controlling a radiation direction of a small sector antenna according to an exemplary embodiment of the present invention.

With reference to FIG. 5, the method for controlling a radiation direction implemented by the apparatus for controlling a radiation direction as described above can be briefed as follows.

In an exemplary embodiment of the present invention, in order to control a radiation direction of the small sector antenna including a single RF port and an array of a plurality of parasitic elements, first, the radiation of the small sector antenna is divided into $N_s$ number of sectors and set in step S61. The $N_s/2+1$) number of capacitors, each having a different capacitance, are provided to be disposed between the plurality of parasitic elements and grounds in step S62. Here, the respective capacitances of the n number of capacitors are set in consideration of the radiation shape and range.

When a radiation direction is selected in step S63, the capacitors are selectively connected between the parasitic elements and the grounds such that parasitic elements located at area symmetrical based on the radiation direction have the same capacitance and parasitic elements located in the radiation direction have different capacitances in step S64.

Namely, when the radiation direction is selected as shown in FIG. 4, the capacitors are selectively connected between the parasitic elements and the grounds such that the parasitic elements located in the sectors (P1 and P3, P4 and P6), symmetrical based on radiation direction, have the same capacitances ($C_2$, $C_3$), while the parasitic elements located in the sectors (P2, P5) in the radiation direction have different capacitances ($C_1$, $C_4$).

As described above, the selective connection of the capacitors to the parasitic elements can be implemented through the switching units such as digital switches, a bias voltage is not required to control the radiation direction and a digital-to-analog converter for converting a control signal to a bias voltage is not required. As a result, the power consumption for controlling the radiation direction can be effectively reduced.

As set forth above, according to exemplary embodiments of the invention, a capacitance value between a parasitic element and a ground is simply adjusted by using an array of a plurality of capacitors, instead of a varactor diode, and a switch, to thereby simplify calculation for controlling a radiation direction or removing the necessity of calculation, thus reducing a load of a wireless transmission device and reducing power consumption otherwise maintaining an operation of the related art digital-to-analog converter. Also, because control signals (i.e., a digital bit stream) for controlling the radiation direction are matched to the radiation directions of each sector in a one-to-one manner, the controlling configuration can be simplified. The simplified control configuration can be applied for a small wireless transmission device having a limited calculation capabilities and limited power to effectively control the radiowave radiation direction.

While the present invention has been shown and described in connection with the exemplary embodiments, it will be apparent to those skilled in the art that modifications and variations can be made without departing from the spirit and scope of the invention as defined by the appended claims.

What is claimed is:

1. An apparatus for controlling a radiation direction of a small sector antenna including a single radio frequency (RF) port and an array of a plurality of parasitic elements, the apparatus comprising:

a plurality of capacitance blocks matched to the plurality of parasitic elements in a one-to-one manner and each respectively including a preset number of capacitors commonly connected to corresponding parasitic elements and each having a different capacitance;

a plurality of switching units matched to the plurality of capacitance blocks in a one-to-one manner and including a plurality of selective contact points connected to the other ends of the capacitors of the corresponding capacitance blocks and a fixed contact point connected to a ground, and performing a switching operation such that the fixed contact point is connected to one of the plurality of selective contact points; and a controller controlling the plurality of switching units, and, wherein the preset number of capacitors is $n=N_s/2+1$ number of capacitors, where $N_s$ is a preset number of sectors in the small sector antenna.

2. The apparatus of claim 1, wherein the controller controls the switching units such that parasitic elements located at symmetrical sectors, based on the radiation direction, have the same capacitance and parasitic elements located at sectors in the radiation direction have different capacitances.

3. The apparatus of claim 1, wherein the plurality of switching units further comprise two selective contact points directly connected to parasitic elements to which corresponding capacitance blocks are connected, and each set for a short mode and an open mode.

4. The apparatus of claim 1, wherein the plurality of switching units are implemented as digital switches connecting a single selective contact point to the fixed contact point according to a control signal from the controller and maintaining the connected state until a next control signal is applied.

5. A method for controlling a radiation direction of a small sector antenna including a single RF port and an array of a plurality of parasitic elements, the method comprising:

dividing a radiation direction of the small sector antenna into a plurality of sectors and setting the same;

disposing a plurality of capacitors between the plurality of parasitic elements and grounds; and selectively connecting the capacitors between the respective parasitic elements and the grounds such that parasitic elements located at symmetrical sectors, based on a selected radiation direction, have the same capacitance and parasitic elements located at sectors in a radiation direction have mutually different capacitances, wherein the plurality of capacitors is preset to $n=N_s/2+1$ number of capacitors, where $N_s$ is a preset number of sectors in the small sector antenna.

6. A method for controlling a radiation direction of a small sector antenna including a single RF port and an array of n parasitic elements, the method comprising:

dividing a radiation direction of the small sector antenna into n sectors;

disposing between each respective of the plurality of parasitic elements and ground $n/2+1$ different valued capacitors; and selectively connecting the capacitors between the respective parasitic elements and ground such that parasitic elements located at symmetrical sectors, based on a selected radiation direction, have the same capacitance and parasitic elements located at sectors in a radiation direction have mutually different capacitances.

* * * * *